US009662540B2

(12) United States Patent
Hsu

(10) Patent No.: US 9,662,540 B2
(45) Date of Patent: May 30, 2017

(54) DUAL-SECURITY BUCKLE DEVICE

(71) Applicant: DONG GUAN QISHI DONGSHAN JUNMING PLASTIC & METAL FACTORY, Dongguan (CN)

(72) Inventor: Chiencheng Hsu, Dongguan (CN)

(73) Assignee: DONG GUAN QISHI DONGSHAN JUNMING PLASTIC & METAL FACTORY, Dongguan, Guangdong Province (CN)

( * ) Notice: Subject to any disclaimer, the term of this patent is extended or adjusted under 35 U.S.C. 154(b) by 305 days.

(21) Appl. No.: 14/530,773

(22) Filed: Nov. 2, 2014

(65) Prior Publication Data

US 2016/0120270 A1 May 5, 2016

(51) Int. Cl.

| | |
|---|---|
| ***A44B 11/25*** | (2006.01) |
| ***A63B 31/11*** | (2006.01) |
| ***A63B 33/00*** | (2006.01) |

(52) U.S. Cl.

CPC ..... *A63B 31/11* (2013.01)

(58) Field of Classification Search

CPC ... A63B 31/11; A63B 33/002; A44B 11/2592; A44B 11/258; A44B 11/263; A44B 11/2569; A44B 11/08; A44B 11/006; A44B 11/005; A44B 11/25; A44B 11/2584; A44B 11/2549; A44B 11/2546; A44B 11/2511

See application file for complete search history.

(56) References Cited

U.S. PATENT DOCUMENTS

| | | | | |
|---|---|---|---|---|
| 2,178,572 A * | 11/1939 | Forstner | ..... | A44B 11/25 24/616 |
| 6,185,794 B1 * | 2/2001 | Maggi | ..... | A63B 31/11 24/170 |
| 6,481,069 B1 * | 11/2002 | Cheng | ..... | A44C 5/2038 24/537 |

* cited by examiner

*Primary Examiner* — Jack W Lavinder

(74) *Attorney, Agent, or Firm* — Leong C. Lei

(57) ABSTRACT

A dual-security buckle device includes a female buckle, a male buckle, and a reinforcement buckle. The female buckle is used to connect the counter of a flipper. The male buckle is used to connect a rope of the flipper. The female buckle main body has a buckle hole. The male buckle has a lock portion. The lock portion of the male buckle is inserted into the buckle hole of the female buckle to achieve the first fastening. The reinforcement buckle is turned to fasten the lock portion of the male buckle tightly to achieve the second fastening. The present invention can enhance the reliability of the buckle device with a dual-buckle design. The present invention is safe and beneficial for a stable connection, not disengagement.

9 Claims, 5 Drawing Sheets

DUAL-SECURITY BUCKLE DEVICE

BACKGROUND OF THE INVENTION

1. Field of the Invention

The present invention relates to a dual-security buckle device used at the position of the heel of a flipper for connecting a rope.

2. Description of the Prior Art

A conventional flipper is formed integrally. The user elects a corresponding size according to the size of his/her foot. The user extends his/her foot into the shoe opening of the flipper, like wearing a shoe. Because the shoe opening doesn't have flexibility, there is a problem that it is easy to wear the flipper and it is easy to fall off. In view of this, an improved flipper is provided with a rope at the counter of the flipper. The rope is locked on the flipper main body with two buckles. By using the buckles, the user can wear the flipper quickly. The rope can be adjusted for different users. This flipper with buckles has some drawbacks for use. The connecting structure of the buckles is simple. After a period of time, the buckles may disengage from each other. In particular, it makes the flipper loosen when used in the water to generate great resistance. This brings troubles to divers. Accordingly, the inventor of the present invention has devoted himself based on his many years of practical experiences to solve these problems.

SUMMARY OF THE INVENTION

The primary object of the present invention is to provide a dual-security buckle device for a flipper, with a dual-buckle design. The present invention is safe beneficial for a stable connection, not disengagement In order to achieve the aforesaid object, the dual-security buckle device of the present invention comprises a female buckle for connecting a counter of a flipper, a male buckle for connecting a rope of the flipper, and a reinforcement buckle. The female buckle comprises a female buckle main body, a spring, and a button. The female buckle main body has a buckle hole. The spring is installed in the female buckle main body. The button is in contact with the spring and pivotally connected to the female buckle main body in a seesaw way. One side of the button, facing the buckle hole, has a first lock portion. The male buckle comprises a male buckle main body, a rope connecting portion at one end of the male buckle main body, and a second lock portion at another end of the male buckle main body. The second lock portion is inserted into the buckle hole to engage with the first lock portion. The reinforcement buckle comprises a buckle arm and two pivot portions at two ends of the buckle arm. The two pivot portions are movably connected to the female buckle main body. The buckle arm is pressed to fasten the second buckle portion of the male buckle.

Compared to the prior art, the present invention has obvious advantages and beneficial effects. The male buckle and the female buckle are engaged with each other to achieve the first fastening. The rope of the flipper is tightly tied on the foot of the diver. The reinforcement buckle is to fasten the male buckle tightly to achieve the second fastening. The present invention can prevent the counter of the flipper and the rope from loosening to achieve a dual-buckle structure. The present invention is safe and has a simple structure and is beneficial for a stable connection, not disengagement.

DETAILED DESCRIPTION OF THE PREFERRED EMBODIMENTS

Figure 1:
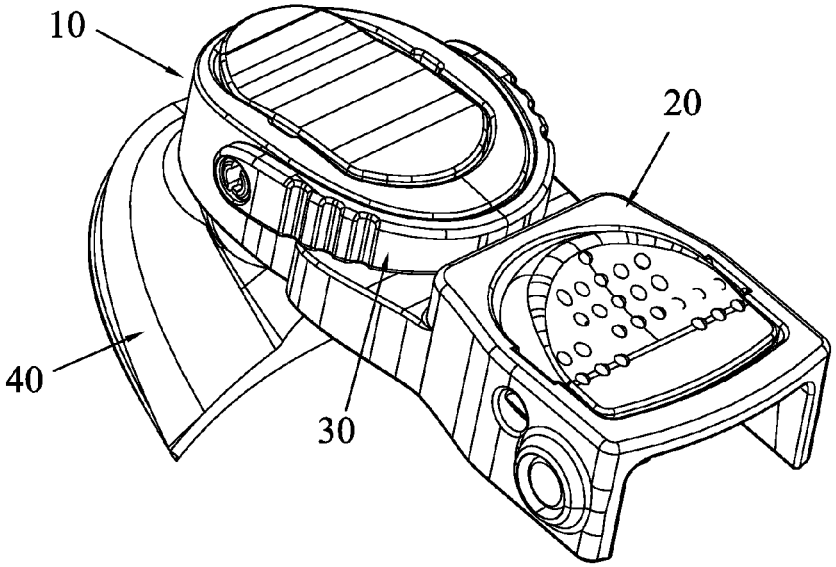
FIG. 1 is a perspective view according to a preferred embodiment of the present invention (wherein the male buckle is buckled to the female buckle, the reinforcement buckle is buckled to the male buckle, and only the counter of the flipped is shown)
Figure 2:
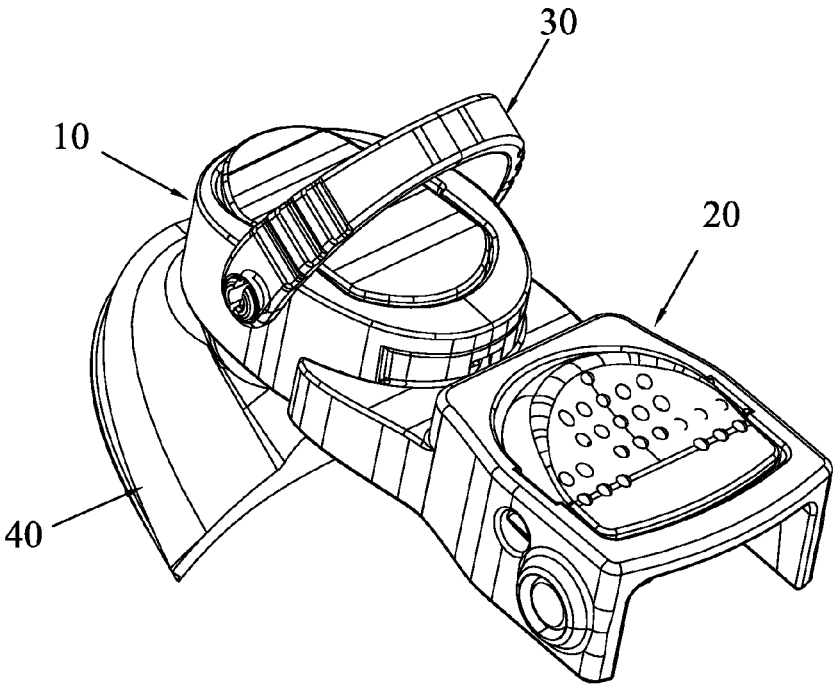
FIG. 2 is a schematic view showing the first fastening of the buckle device of the present invention (the male buckle is buckled to the female buckle)

Embodiments of the present invention will now be described, by way of example only, with reference to the accompanying drawings.

FIG. 1 to FIG. 7 shows a preferred embodiment of the present invention. The present invention discloses a dual-security buckle device which can be used at the position of the heel of a flipper 40 for connecting a rope, but not limited to diving appliances. It can be applied for connection of the rope of a package or a bag through a partial structure improvement.

The dual-security buckle device comprises a female buckle 10, a male buckle 20, and a reinforcement buckle 30. The female buckle 10 is used to connect the counter of the flipper 40. The male buckle 20 is used to connect the rope of the flipper 40.

The female buckle 10 comprises a female buckle main body 11, a spring 12, and a button 13. The female buckle main body 11 has a buckle hole 111. The spring 12 is installed in the female buckle main body 11. The button 13 is in contact with the spring 12 and pivotally connected to the female buckle main body 11 in a seesaw way. One side of the button 13, facing the buckle hole 111, has a first lock portion 131. The male buckle 20 comprises a male buckle main body 21, a rope connecting portion 22 at one end of the male buckle main body 21, and a second lock portion 23 at another end of the male buckle main body 21. The second lock portion 23 is inserted into the buckle hole 111 to engage with the first lock portion 131. The reinforcement buckle 30 comprises a buckle arm 31 and two pivot portions 32 at two ends of the buckle arm 31. The two pivot portions 32 are movably connected to the female buckle main body 11. The buckle arm 31 is pressed to fasten the second buckle portion 23 of the male buckle 20. Thus, the second lock portion 23 of the male buckle 20 and the female buckle 10 are buckled each other to achieve the first fastening. After that, the reinforcement buckle 30 is to fasten the second lock portion 23 of the male buckle 20 to achieve the second fastening. This can enhance the reliability of the buckle device. The dual-buckle design enhances safety and is beneficial for a stable connection, not disengagement.

The specific structure of the female buckle 10 is described hereinafter. The female buckle main body 11 has an oval shape, and is composed of a bottom wall 112, an annular side wall 113, and an oval top wall 114. The bottom wall 112 is formed with an installation hole 115 for connecting the flipper 40. The front end of the side wall 113 is formed with the buckle hole 111. The top wall 114 is formed with a button hole 116 to accommodate the button 13. The button 13 is installed in the button hole 116. Two sides of the button 13 are provided with turning portions 132. Two sides of the side wall 113 of the female buckle main body 11 have two axle holes 117 corresponding in position to the turning portions 132 of the button 13. The turning portions 132 are installed in the axle holes 117 in a rotatable manner. Another end of the bottom wall 112 of the female buckle main body 11, away from the buckle hole 111, is provided with a protruding post 118. The spring 12 is fitted on the protruding post 118. The spring 12 is disposed between the button 13 and the bottom wall 112 of the female buckle main body 11. The pivot portions 32 of the reinforcement buckle 30 are two axle holes. Two outer sides of the side wall 113 of the female buckle main body 11 are provided with protruding axles 119 corresponding in position to the pivot portions 32 of the reinforcement buckle 30. The protruding axles 119 are rotatably mounted in the axle holes 117.

The specific structure of the male buckle 20 and the mating design of the male buckle 20 and the female buckle 10 are described hereinafter. The second lock portion 23 of the male buckle main body 21 comprises an insertion platform 231, a lock tongue 232 which is integrally formed with a head end of the insertion platform 231, and a raised platform 233 protruding from the insertion platform 231. The lock tongue 232 and the raised platform 233 form a step. The buckle hole 111 of the female buckle main body 11 is composed of a wide hole 1111 and a narrow hole 1112. When the insertion platform 231 is inserted into the buckle hole 111, the lock tongue 232 is engaged in the wide hole 1111 and the raised platform 233 is engaged in the narrow hole 1112. A buckle recess 234 is formed between the insertion platform 231 and one side of the raised platform 233 of the male buckle main body 21, opposite the lock tongue 232. The buckle arm 31 of the reinforcement buckle 30 is buckled in the buckle recess 234. The buckle tongue 235 of the male buckle main body 21 has a first barb. The first lock portion 131 of the button 13 is a second barb. The first barb and the second barb are engaged with each other. The rope connecting portion 22 of the male buckle main body 21 comprises an accommodation room 221, a rolling shaft 222, and a press button 223. The rolling shaft 222 is transversely disposed in the accommodation room 221. The press button 223 is connected to the side wall of the accommodation room 221 in a seesaw manner. The press button 223 is located above the rolling shaft 222 to cover the accommodation room 221. The press button 223 has a press surface 2231, a contact rod 2232, and a press rib 2233. The press surface 2231 is formed with anti-slip dots 2234. The contact rod 2232 extends obliquely from the bottom of the press surface 2231 to contact the bottom of the accommodation room 221. The press rib 2233 faces the rolling shaft 222. A slit 2235 is formed between the press rib 2233 and the rolling shaft 222 for a rope to pass therethrough.

Figure 3:
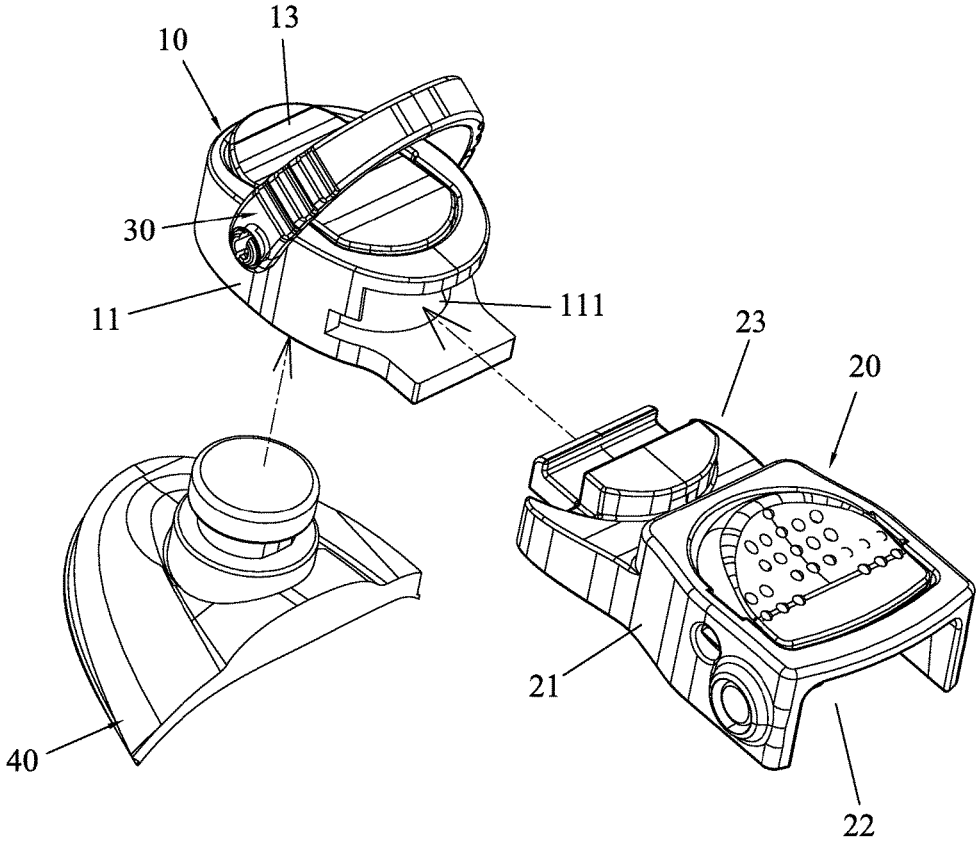
FIG. 3 is a schematic view showing the preferred embodiment of the present invention in an unlocked state.
Figure 4:
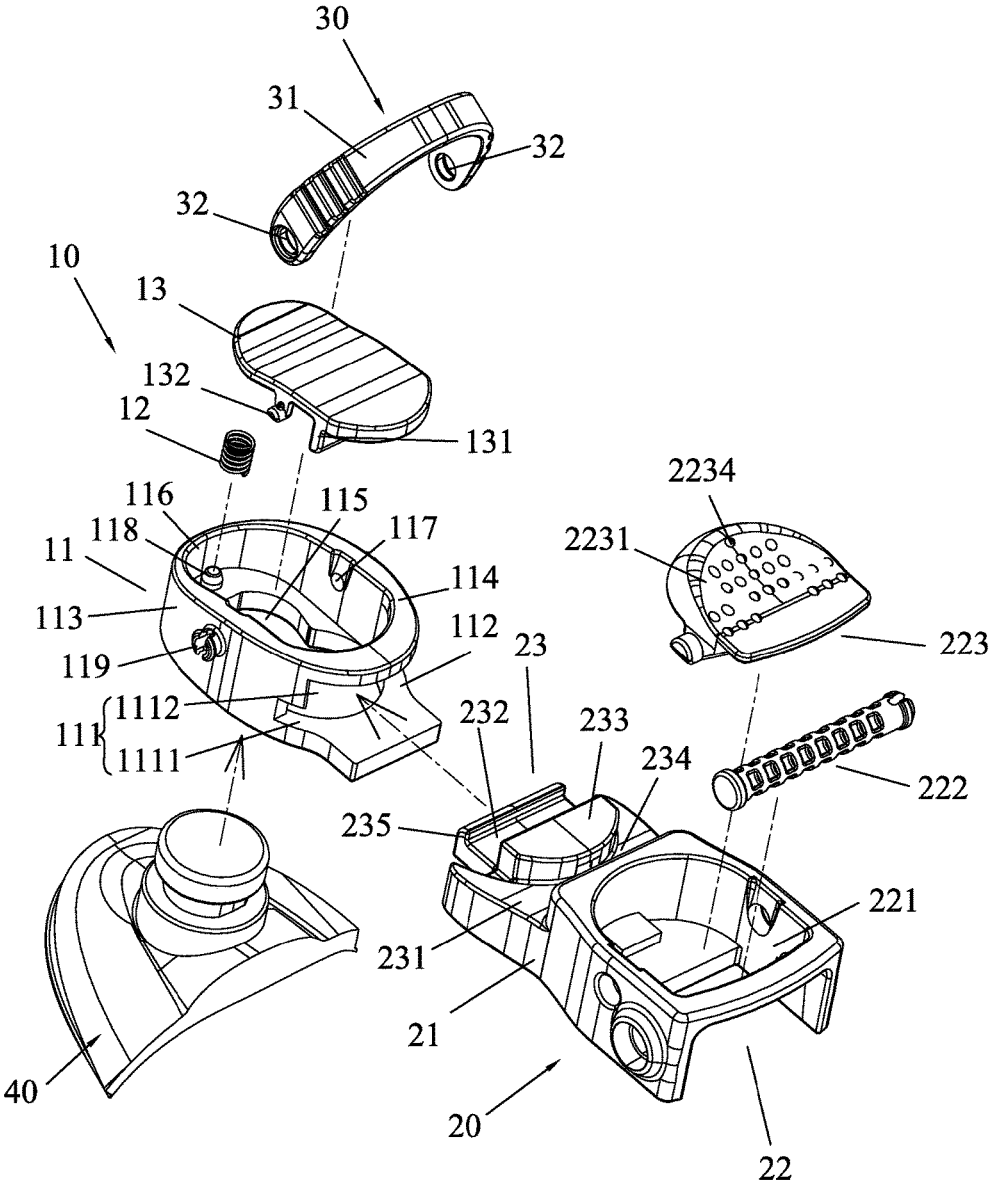
FIG. 4 is an exploded view according to the preferred embodiment of the present invention.
Figure 5:
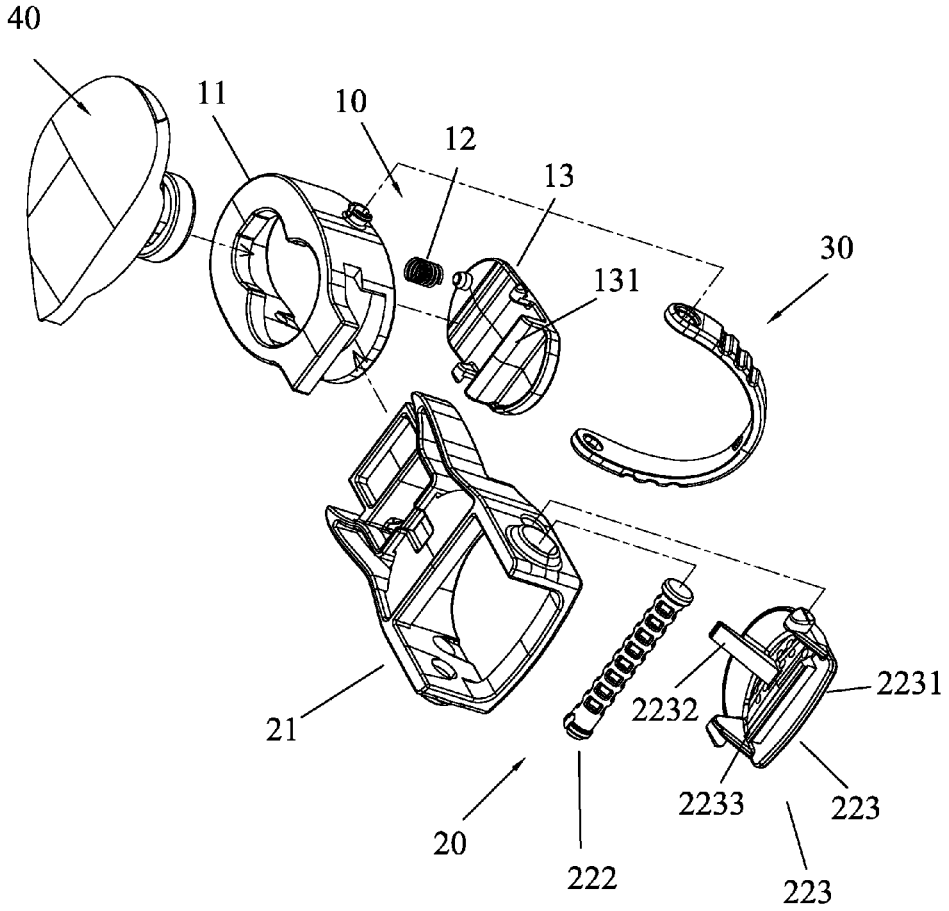
FIG. 5 is another exploded view according to the preferred embodiment of the present invention seen from another angle.
Figure 6:
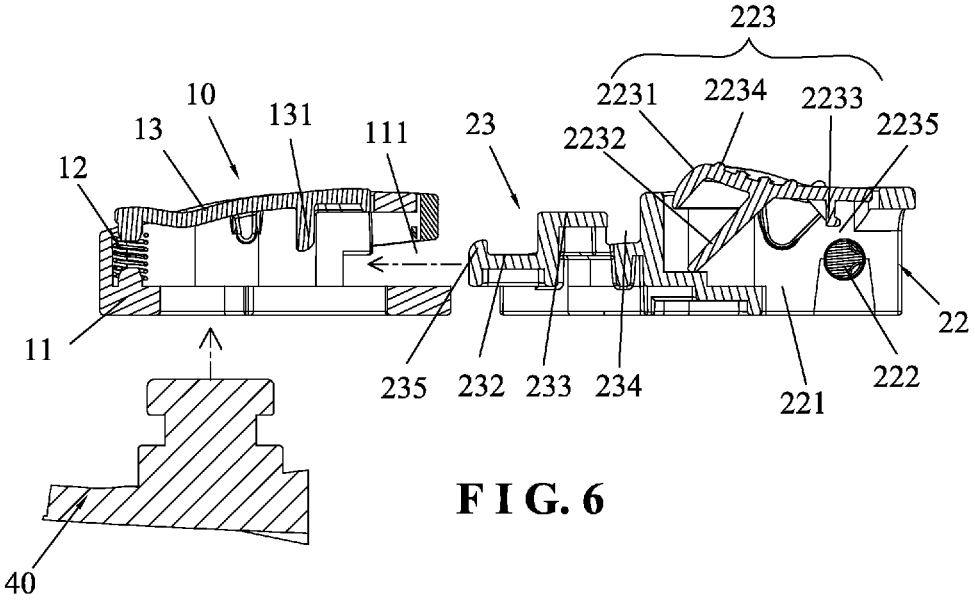
FIG. 6 is a sectional view showing the preferred embodiment of the present invention in an unlocked state.
Figure 7:
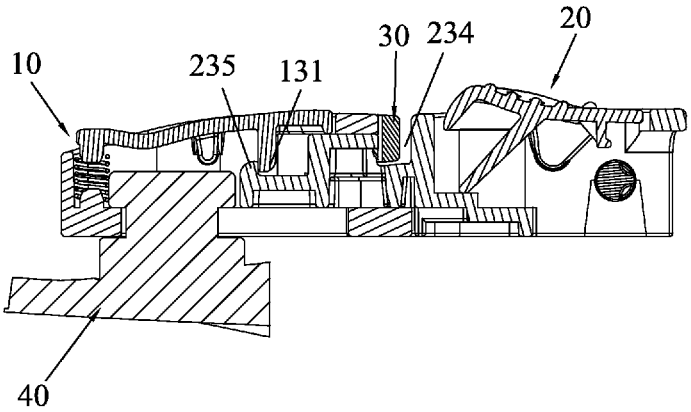
FIG. 7 is a schematic view showing the preferred embodiment of the present invention in a locked state.

As shown in FIG. 3 and FIG. 6, when in use, the heel of the flipper 40 is engaged in the installation hole 115 of the female buckle 10, such that the female buckle 10 is secured on the flipper 40. After that, the rope is inserted into the rope connecting portion 22 of the male buckle 20, such that the male buckle 20 is secured on the rope. The male buckle 20 and the female buckle 10 are engaged with each other to achieve the first fastening. Finally, the reinforcement buckle 30 is turned to be buckled in the buckle recess 234 tightly to achieve the second fastening. This way can enhance the reliability of the buckle device. The dual-buckle design enhances safety and is beneficial for a stable connection, not disengagement.

The feature of the present invention is that the male buckle 20 and the female buckle 10 are engaged with each other to achieve the first fastening. The rope of the flipper 40 is tightly tied on the foot of the diver. The reinforcement buckle 30 is to fasten the male buckle 20 tightly to achieve the second fastening. The present invention can prevent the counter of the flipper 40 and the rope from loosening to achieve a dual-buckle structure. The present invention is safe and has a simple structure and is beneficial for a stable connection, not disengagement.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A dual-security buckle device, comprising a female buckle for connecting a counter of a flipper, a male buckle for connecting a rope of the flipper, and a reinforcement buckle;

the female buckle comprising a female buckle main body, a spring, and a button, the female buckle main body having a buckle hole, the spring being installed in the female buckle main body, the button being in contact with the spring and pivotally connected to the female buckle main body in a seesaw way, one side of the button, facing the buckle hole, having a first lock portion;

the male buckle comprising a male buckle main body, a rope connecting portion at one end of the male buckle main body, and a second lock portion at another end of the male buckle main body, the second lock portion being inserted into the buckle hole to engage with the first lock portion;

the reinforcement buckle comprising a buckle arm and two pivot portions at two ends of the buckle arm, the two pivot portions being movably connected to the female buckle main body, the buckle arm being pressed to fasten the second buckle portion of the male buckle;

wherein the second lock portion of the male buckle main body comprises an insertion platform, a lock tongue which is integrally formed with a head end of the insertion platform, and a raised platform protruding from the insertion platform, the lock tongue and the raised platform forming a step, the buckle hole of the female buckle main body being composed of a wide hole and a narrow hole, wherein when the insertion platform is inserted into the buckle hole, the lock tongue is engaged in the wide hole and the raised platform is engaged in the narrow hole.

2. The dual-security buckle device as claimed in claim 1, wherein the female buckle main body has an oval shape and is composed of a bottom wall, an annular side wall, and an oval top wall, the bottom wall being formed with an installation hole for connecting the flipper, a front end of the side wall being formed with the buckle hole, the top wall being formed with a button hole to accommodate the button.

3. The dual-security buckle device as claimed in claim 2, wherein the button is installed in the button hole, two sides of the button being provided with turning portions, two sides of the side wall of the female buckle main body having two axle holes corresponding in position to the turning portions of the button, the turning portions being installed in the axle holes in a rotatable manner.

4. The dual-security buckle device as claimed in claim 3, wherein another end of the bottom wall of the female buckle main body, away from the buckle hole, is provided with a protruding post, the spring being fitted on the protruding post, the spring being disposed between the button and the bottom wall of the female buckle main body.

5. The dual-security buckle device as claimed in claim 2, wherein the pivot portions of the reinforcement buckle are two axle holes, two outer sides of the side wall of the female buckle main body being provided with protruding axles corresponding in position to the pivot portions of the reinforcement buckle, the protruding axles being rotatably mounted in the axle holes.

6. The dual-security buckle device as claimed in claim 1, wherein a buckle recess is formed between the insertion platform and one side of the raised platform of the male buckle main body, opposite the lock tongue, the buckle arm of the reinforcement buckle being buckled in the buckle recess.

7. The dual-security buckle device as claimed in claim 1, wherein the buckle tongue of the male buckle main body has a first barb, the first lock portion of the button being a second barb, the first barb and the second barb being engaged with each other.

8. The dual-security buckle device as claimed in claim 1, wherein the rope connecting portion of the male buckle main body comprises an accommodation room, a rolling shaft, and a press button, the rolling shaft being transversely disposed in the accommodation room, the press button being connected to a side wall of the accommodation room in a seesaw manner, the press button being located above the rolling shaft to cover the accommodation room.

9. The dual-security buckle device as claimed in claim 8, wherein the press button has a press surface, a contact rod, and a press rib, the press surface being formed with anti-slip dots, the contact rod extending obliquely from a bottom of the press surface to contact a bottom of the accommodation room, the press rib facing the rolling shaft, a slit being formed between the press rib and the rolling shaft for a rope to pass therethrough.

* * * * *